US006332326B1

(12) United States Patent
Shim

(10) Patent No.: US 6,332,326 B1
(45) Date of Patent: Dec. 25, 2001

(54) DEHUMIDIFICATION SYSTEM OF UNDERGROUND STORAGE FACILITIES AND A METHOD FOR DEHUMIDIFICATION THEREBY

(75) Inventor: Shang Kooun Shim, Seoul (KR)

(73) Assignee: Himssen Esco Co., Ltd., Seoul (KR)

( * ) Notice: Subject to any disclaimer, the term of this patent is extended or adjusted under 35 U.S.C. 154(b) by 0 days.

(21) Appl. No.: 09/537,707

(22) Filed: Mar. 30, 2000

(30) Foreign Application Priority Data

Jun. 29, 1999 (KR) ..... 99-25280

(51) Int. Cl.[7] ..... F25D 17/06
(52) U.S. Cl. ..... 62/93; 62/273; 62/283
(58) Field of Search ..... 62/273, 93, 283

(56) References Cited

U.S. PATENT DOCUMENTS 3,438,163 * 4/1969 Vevoda ..... 62/273
3,826,106 * 7/1974 O'Hanlon et al. ..... 62/275
4,615,176 * 10/1986 Tippmann ..... 62/62
4,759,195 * 7/1988 Biancardi ..... 62/283
5,979,170 * 11/1999 Thorpe ..... 62/271
6,161,312 * 12/2000 Yang ..... 34/565
6,168,086 * 1/2001 Tanenbaum ..... 237/19
6,185,943 * 2/2001 Kopko ..... 62/89

* cited by examiner

*Primary Examiner*—William Doerrler
*Assistant Examiner*—Mark Shulman
(74) *Attorney, Agent, or Firm*—Birch, Stewart, Kolasch & Birch, LLP

(57) ABSTRACT

The present invention relates to a system and a method for eliminating the dampness or moisture included in the incoming atmosphere(or air) with high temperature and humidity from outside into the underground storage facilities by condensing the moisture to water-drops. The present invention suggests an underground facility having a dehumidification system comprising an inside wall depart from a wall of the underground facility to inside area with a distance, a buffering space formed between the wall and the inside wall, so that the inside wall divide the buffering space and a room of the underground facility and, a ventilation means by which air can be circulated between the room and the buffering space. According to the present invention, it is not need to install any air conditioner or dehumidifier needing a expensive cost for equipment at first and consuming much electrical power and maintenance cost in usage.

13 Claims, 14 Drawing Sheets

DEHUMIDIFICATION SYSTEM OF UNDERGROUND STORAGE FACILITIES AND A METHOD FOR DEHUMIDIFICATION THEREBY

BACKGROUND OF THE INVENTION

1. Field of the Invention

The present invention relates to a system and a method for eliminating the dampness in the incoming atmosphere(air) which flows from outside into the underground or semi-underground storage facilities in which all kinds of food, pharmacies, goods, etc. are in custody under the condition of the constant temperature and humidity for a long term period. Especially, the present invention relates to a system and a method for eliminating the dampness or moisture in the incoming atmosphere with high temperature and humidity which flows from outside into the underground storage facilities by condensing the moisture into water-drops.

2. Description of the Background Art

The typical underground facilities are constructed into or under the earth in order to use them as storage spaces for goods or as living spaces for people. In order to use the underground facilities efficiently, it is very important to maintain the atmosphere circumstance of the underground facilities appropriately to its usage. Contrary to the on-ground, the underground has the constant temperature circumstance of about 10~15 centigrade degree. Generally, the storage facilities demanded the constant temperature circumstance to be constructed underground. Therefore, at least one of the wall 1*a*, the ceiling 1*b* and, the bottom 1*c* of the underground facilities is under the earth(ground) 99, as shown in the FIG. 1. The temperature of the ground or underground exerts an important effect on the temperature of the inside space of the underground facilities. If the underground facilities are isolated from the outside circumstance, then the temperature and the humidity does not change. However, the outside atmosphere generally flows into the underground facilities according to loading and unloading of the stored goods. If the outside atmosphere is low in temperature and humidity, then the incoming atmosphere does not influence the inside atmosphere of the underground facilities. If the outside atmosphere is high in humidity, then the inside atmosphere of the underground facilities could have humidity problems. For example, if the outside atmosphere is in higher temperature and humidity than those of the inside atmosphere of the underground facilities, the humidity inside the underground facilities increases in case the air flows inside from the outside. The incoming atmosphere of high temperature and humidity which flows from the above-ground into the underground facilities is in contact with the inside wall of the underground facilities and the stored goods therein. The temperature of the atmosphere which came from the outside falls as it contacts the underground circumstances while having the outside humidity of high ratio. Generally, the temperature of the underground facilities is lower than the due point of the incoming atmosphere. Therefore, the dampness of the incoming atmosphere condenses at the surface of the inside wall of the underground facilities and the stored goods therein. As a result, it is easy for the moisture of the incoming atmosphere to condense at the surface of the stored goods and surface of the wall, the ceiling and the bottom of the underground facilities. Then, the underground facilities cannot be used as the storage facilities. Especially, dew grows at the surface of the wall and the ceiling of the underground facilities as the temperature of the wall is lower than that of the inside atmosphere of the underground facilities.

In order to overcome the above mentioned problem, a heat shielding material 2 is applied on the inside surface of the underground facilities, that is, the wall 1*a*, the ceiling 1*b* and, the bottom 1*c*, as shown in FIG. 2. To do this, the lower temperature of the wall 1*a* contacting the earth 99 should be isolated from the inside atmosphere 11 of the underground facilities. Generally, the heat isolation material has two types, one is the panel type and the other is the spray type. When the panel type is applied, the atmosphere of the underground facilities can still contact the wall through the gap of the panels and the dew drops occur. The dewdrops may cause many unexpected problems. When the spray type is applied, no such dew occurs on the surface of the heat isolation material. However, the humidity problem inside the underground facilities is not eliminated basically. Therefore, in order to maintain the profit humidity condition for storing goods, de-humidification facilities are needed.

The typical conventional underground facilities applying the panel type heat isolation material is mentioned below in detail. As shown in FIG. 3, an heat insulation layer 2 is formed by tiling the panel type heat insulation materials on the inside surface of the wall 1*a* of underground facilities. Generally, it is hard to plaster or paint on the surface of the heat insulation layer 2. Therefore, an inside wall 3 is constructed inside the underground facilities apart from the surface of the heat insulation layer 2 with certain a distance. As a result, a buffing space 4 is formed between the inside surface of the wall 1 of the underground facilities and the inside wall 3. In this case, the condensation occurs easily in the buffering space 4, especially, between the surface of the wall 1*a* and heat insulating layer 2. In order to treat the dewdrops resulting from the condensation, an water-draining trench 5 is formed facilities at the bottom of the buffing space 4 by constructing an water-proof groove 6 defining boundary between the buffering space 4 and the room of the underground. Furthermore, a ventilation window 11 is formed on the inside wall 3 in order to reduce the degree of humidity at the buffering space 4. However, the root cause of the high humidity or the over humidity in the underground facilities is not solved. Therefore, an additional facilities for dehumidification are needed. Generally, a dehumidifier and an air-conditioner are used for eliminating the moisture in the outside atmosphere which flows into the room of the underground facilities. However, installing these dehumidification facilities and maintaining these above mentioned facilities are very expensive.

SUMMARY OF THE INVENTION

One object of the present invention is to provide an underground facilities having a dehumidification system and a method for dehumidificating the room atmosphere in the underground facilities. Another object is to provide a dehumidification system using an active condensation inducing device in the underground facilities and a method for dehumidification thereby. Yet another object is to provide an underground facility maintaining its room humidity to be in a lowered state and a method for maintaining the room humidity to be in a lowered state which is low enough to prevent the condensation problem from occurring on the goods in the storage facilities.

In order to achieve these objects, the present invention suggests an underground facility having a dehumidification system comprising an inside wall departing from a wall of the underground facility towards the inside area with a distance, a buffering space formed between the wall and the inside wall so that the inside wall divides the buffering space and a room of the underground facility and a ventilation means by which air is circulated between the room and the buffering space. Also, the present invention suggests a method for dehumidification in the underground facility comprising steps of dividing the inside space of the underground facility into two parts by constructing an inside wall near the wall so that one space formed between the inside wall and the wall is buffering space and the other space is a room space of the underground facility, flowing the air of the room space into the buffer space having the lower temperature than the room space so that the moisture in the inflow air is eliminated by condensation and exhausting the being dry air in the buffer space back into the room space of the underground facility.

BRIEF DESCRIPTION OF THE ATTACHED DRAWINGS

Figure 1:
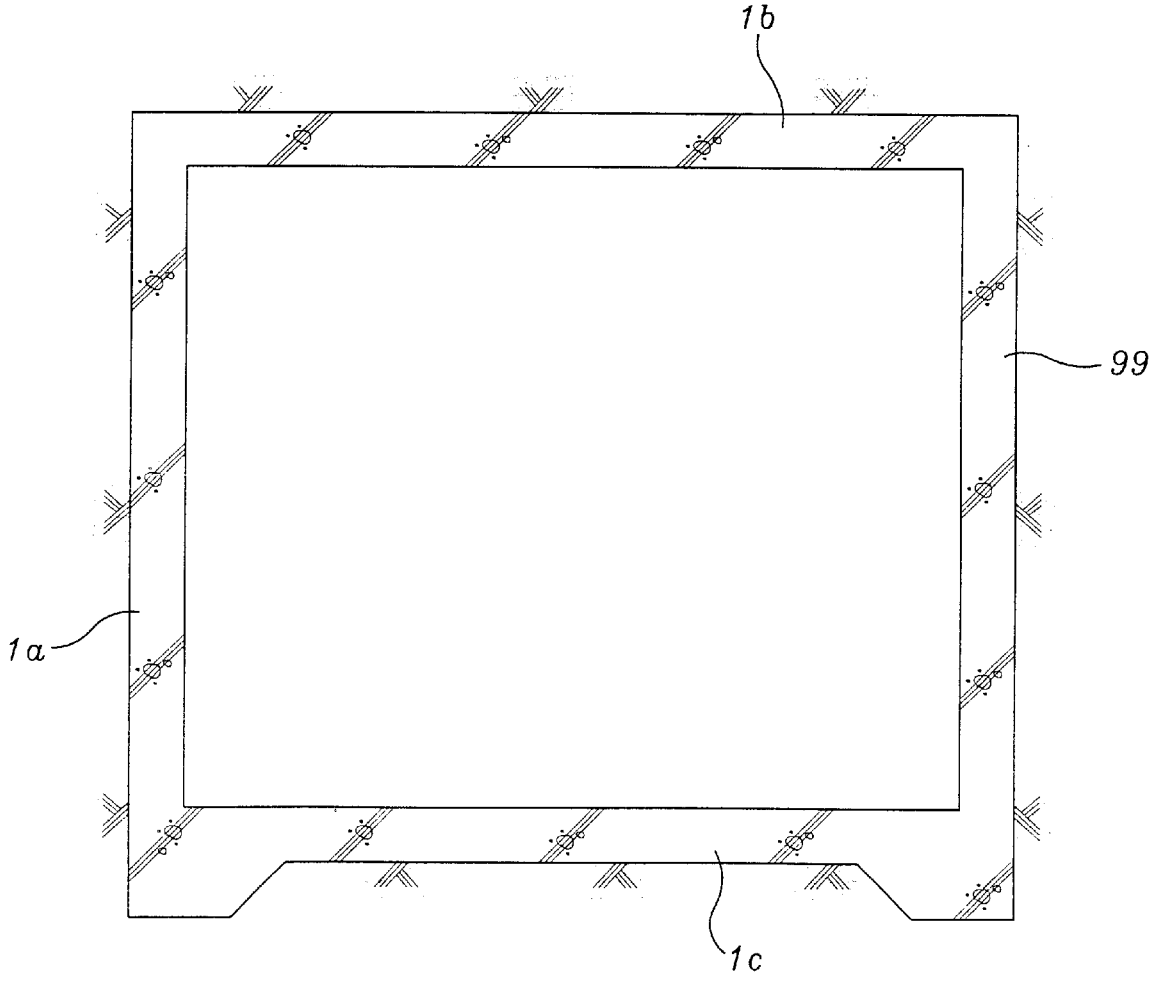
Fig. 1 conventional art
FIG. 1 is a cross-sectional view illustrating the conventional underground storage facility.
Figure 2:
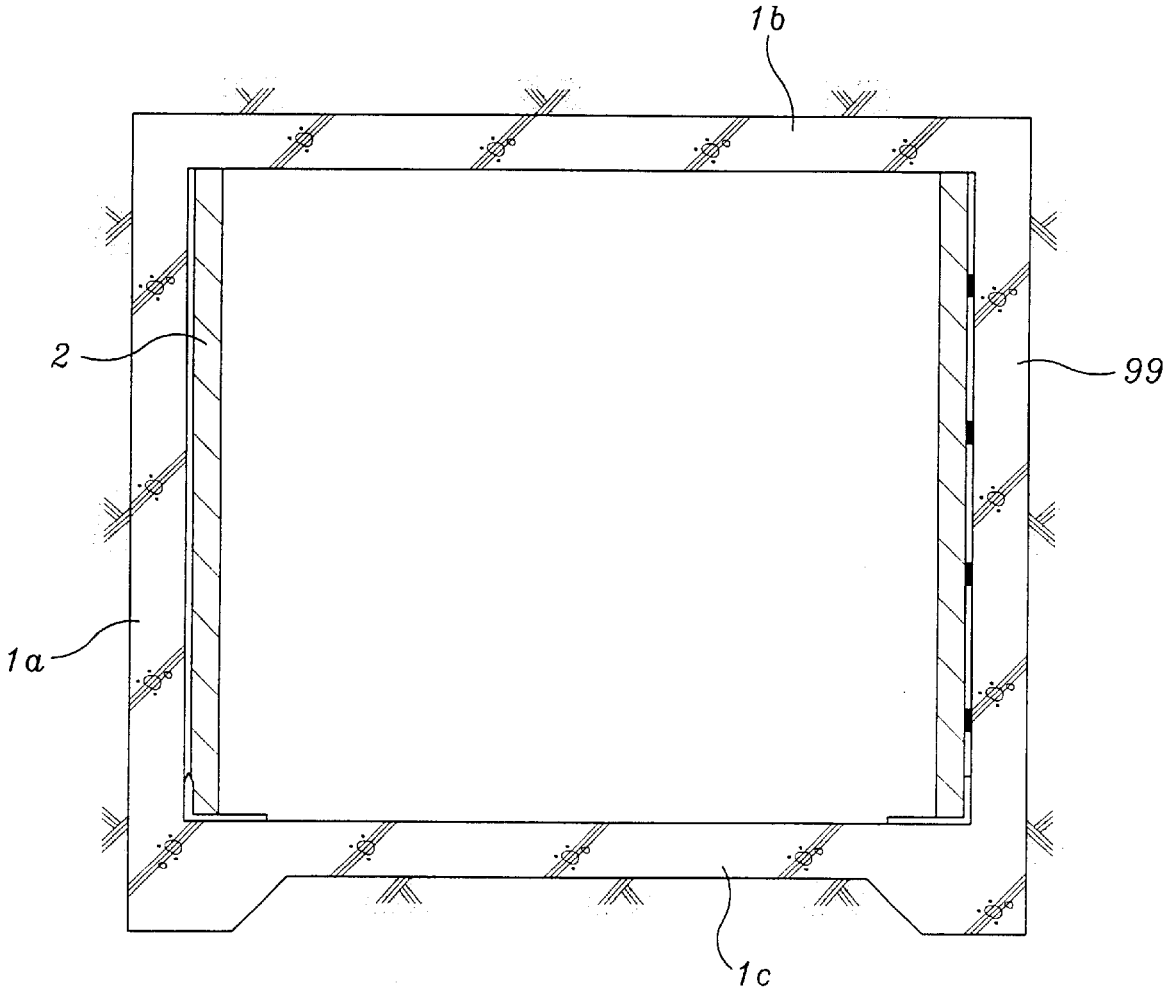
Fig. 2 conventional art
FIG. 2 is a cross-section view illustrating the conventional underground storage facility with the heat insulating material on the inside surface of the wall.
Figure 3:
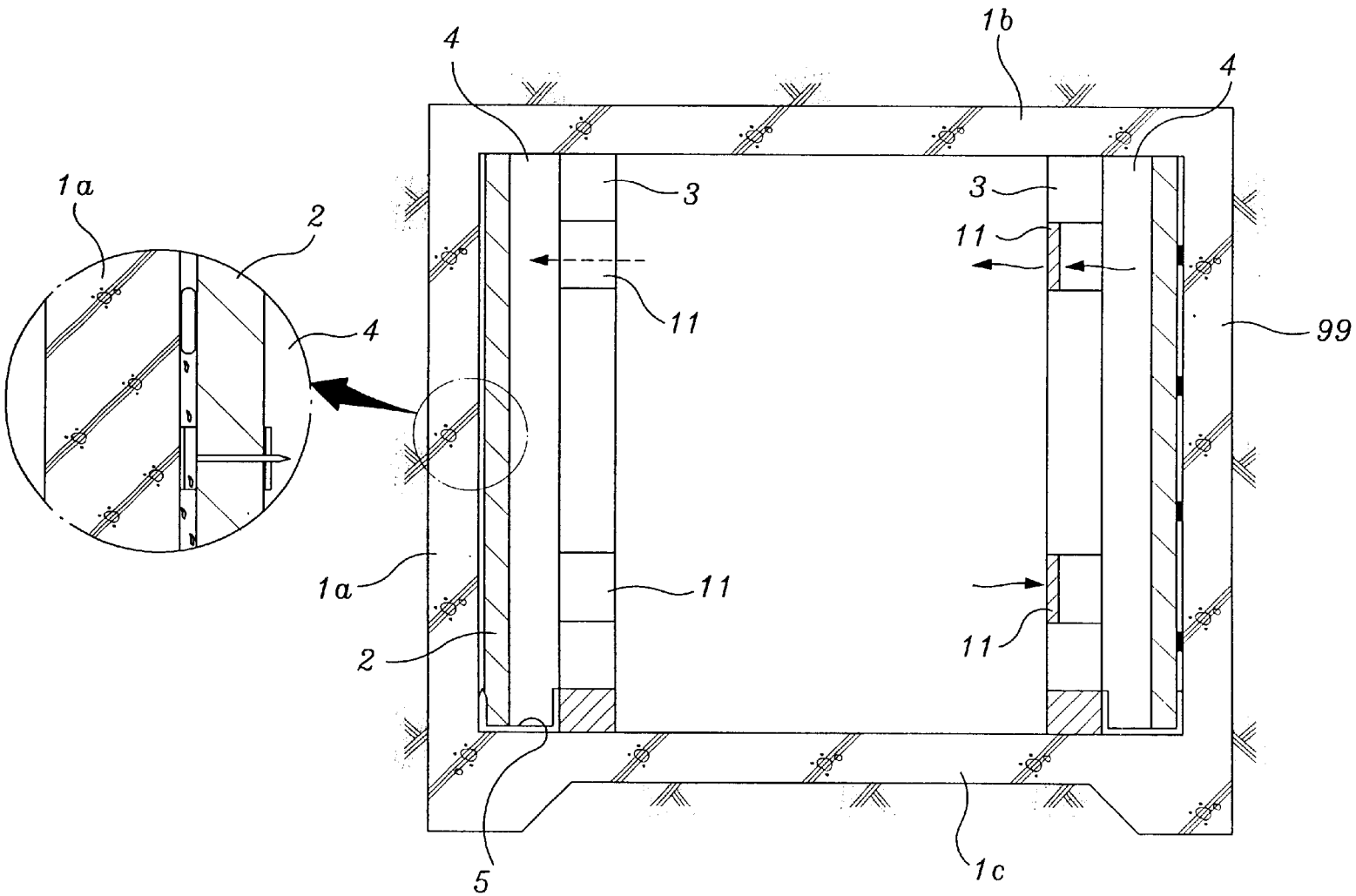
Fig. 3 conventional art
FIG. 3 is a cross-sectional view illustrating the conventional underground storage facility with the panel type heat insulating material on the inside surface of the wall.
Figure 4A:
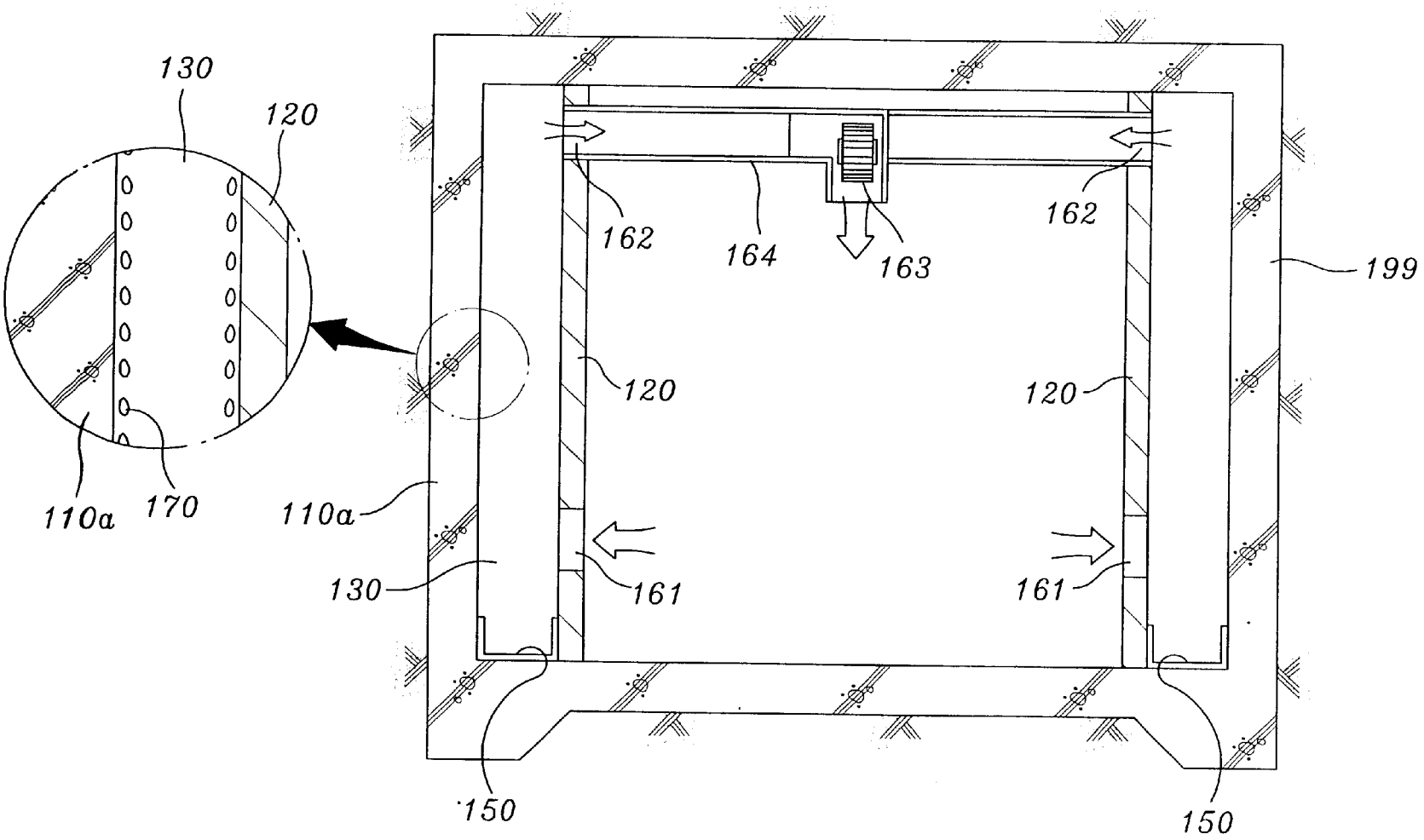

FIG. 4*a* is a cross-sectional view showing the structure of the underground facility with buffing space according to the present invention.

Figure 4B:
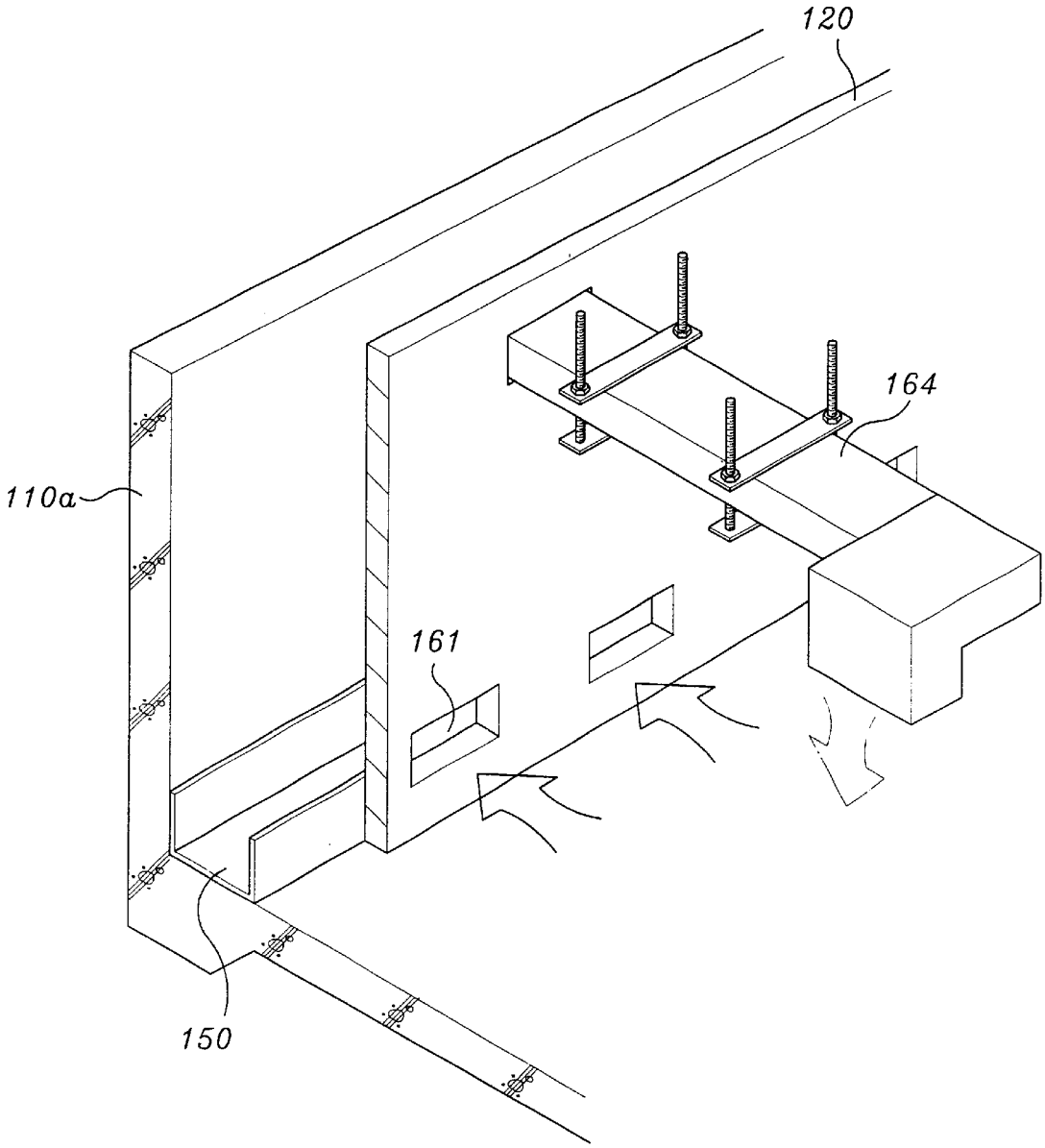

FIG. 4*b* is a perspective view showing the structure of the underground facility according to the present invention.

Figure 5A:
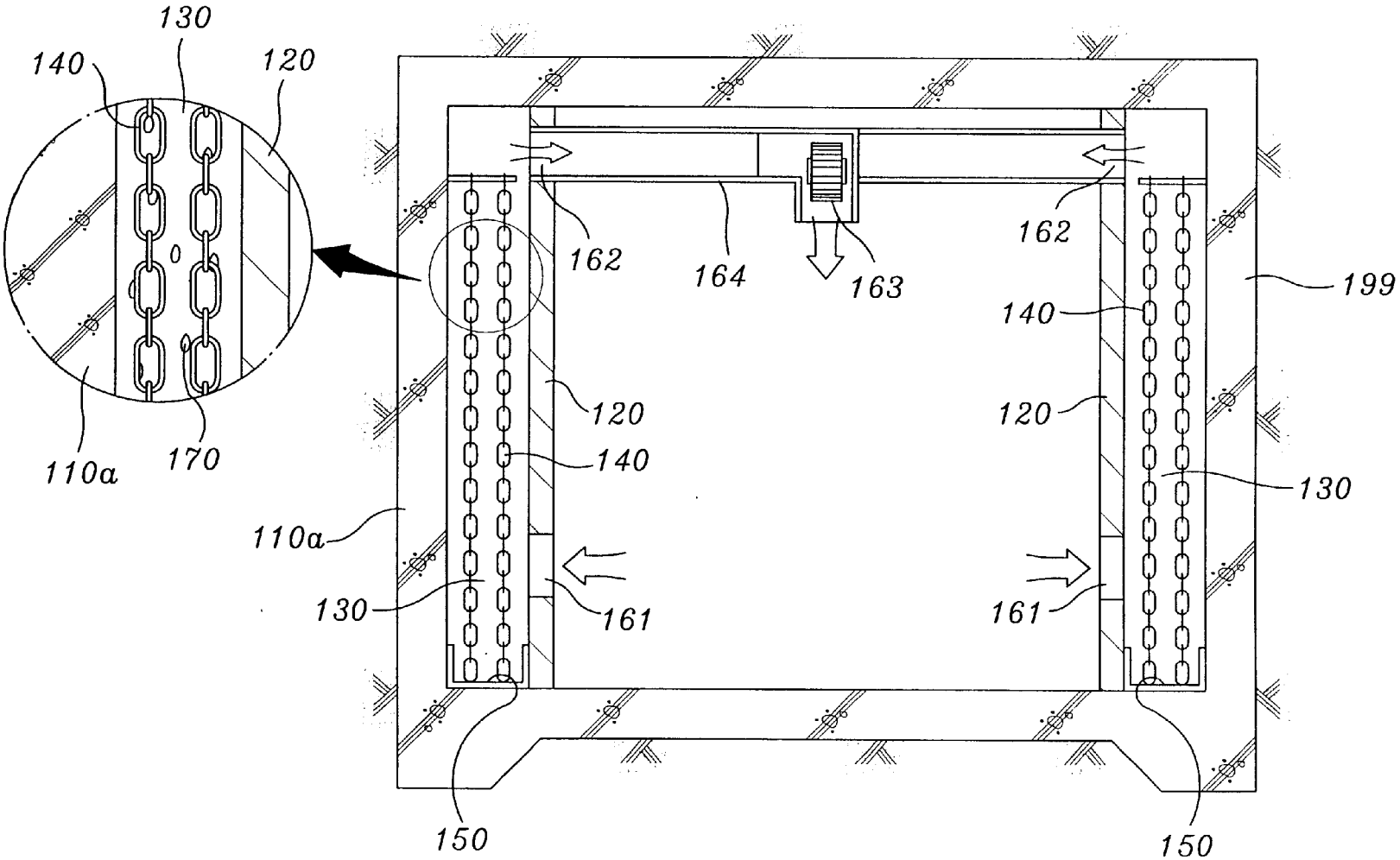

FIG. 5*a* is a cross-sectional view showing the structure of the underground facility according to the present invention.

Figure 5B:
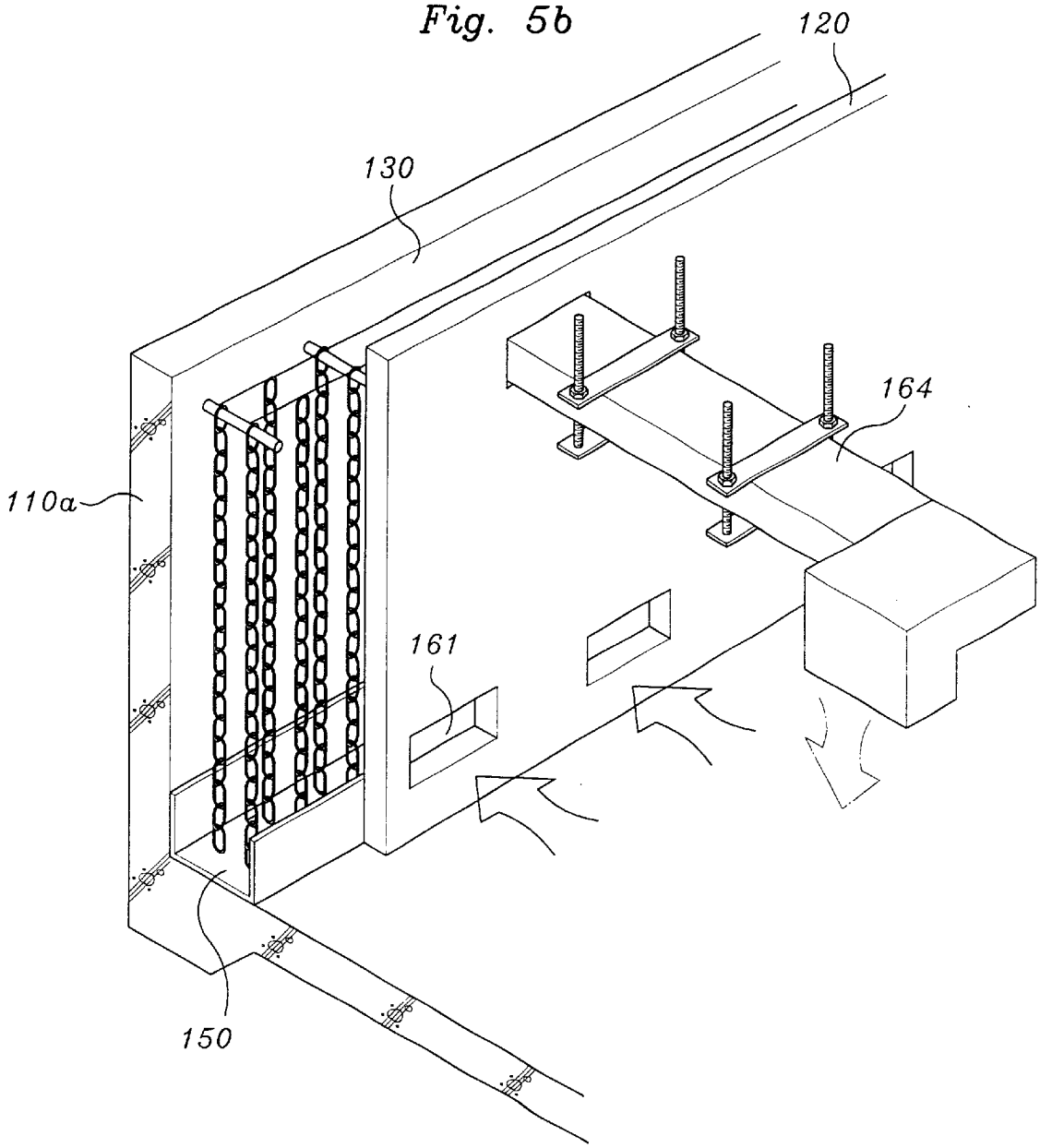

FIG. 5*b* is a perspective view with a condensation inductor in the buffering space according to the present invention.

Figure 6:
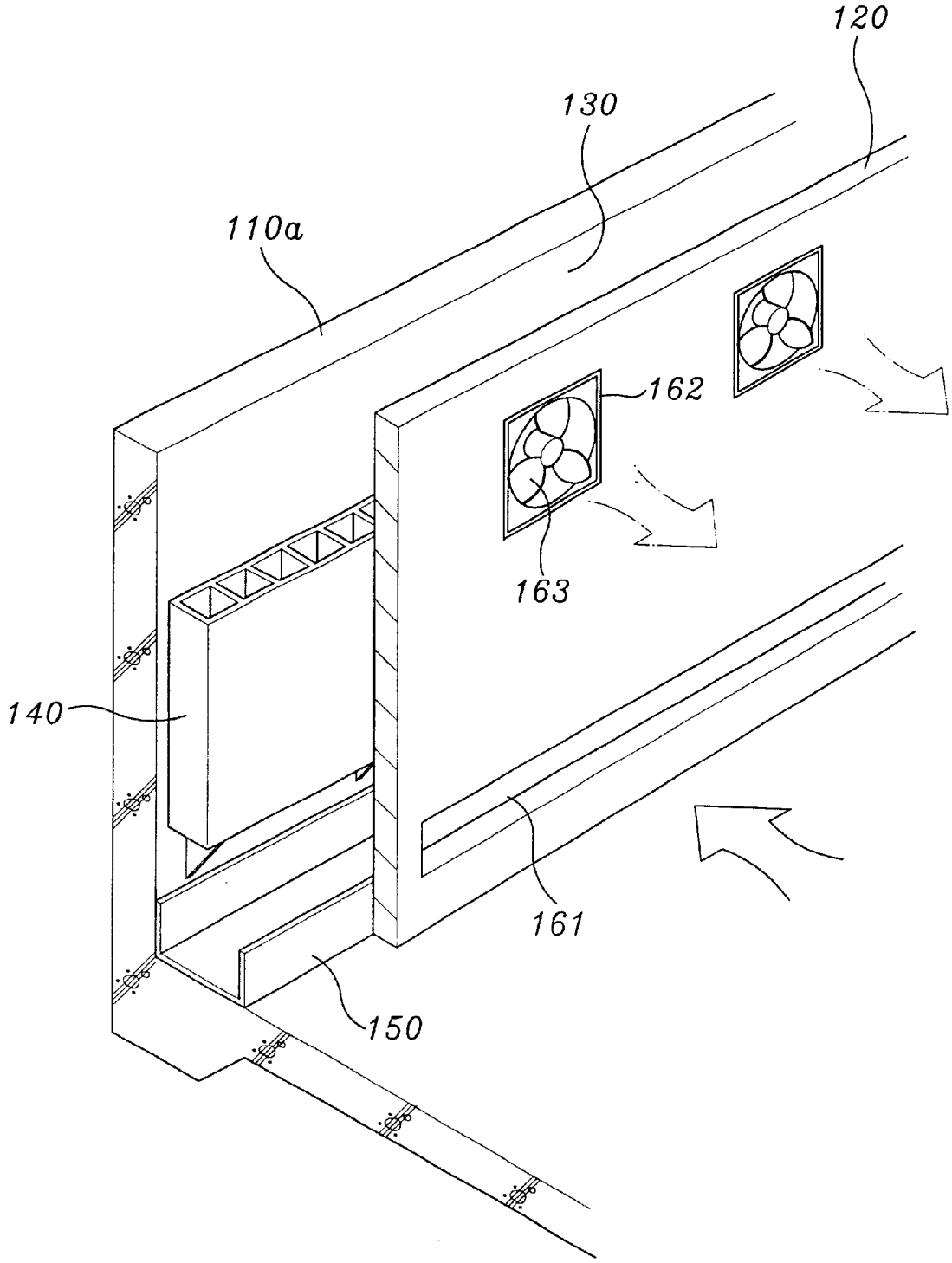

FIG. 6 is a perspective view showing another example of the present invention.

Figure 7A:
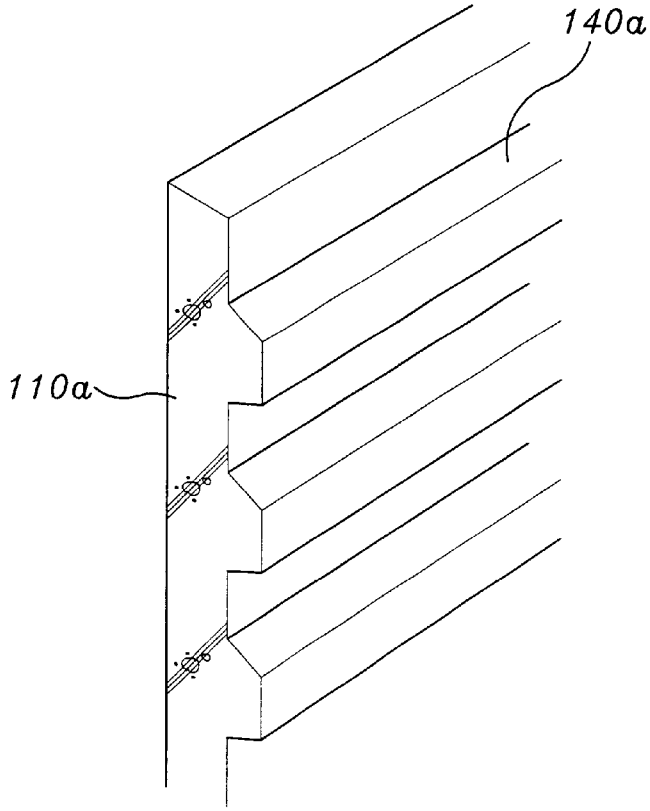
Figure 7B:
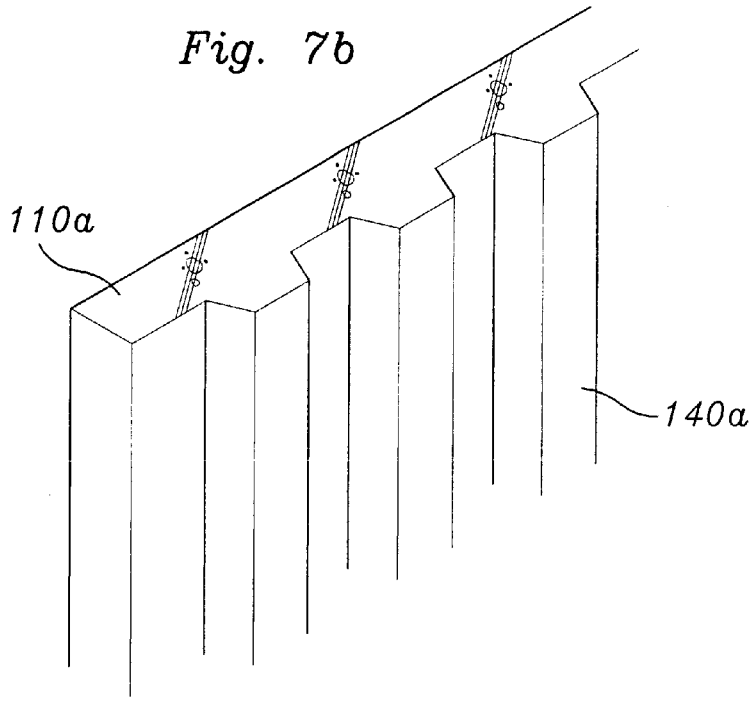

FIGS. 7*a* and 7*b* are perspective views showing examples of condensation inductors formed with a concrete wall.

Figure 7C:
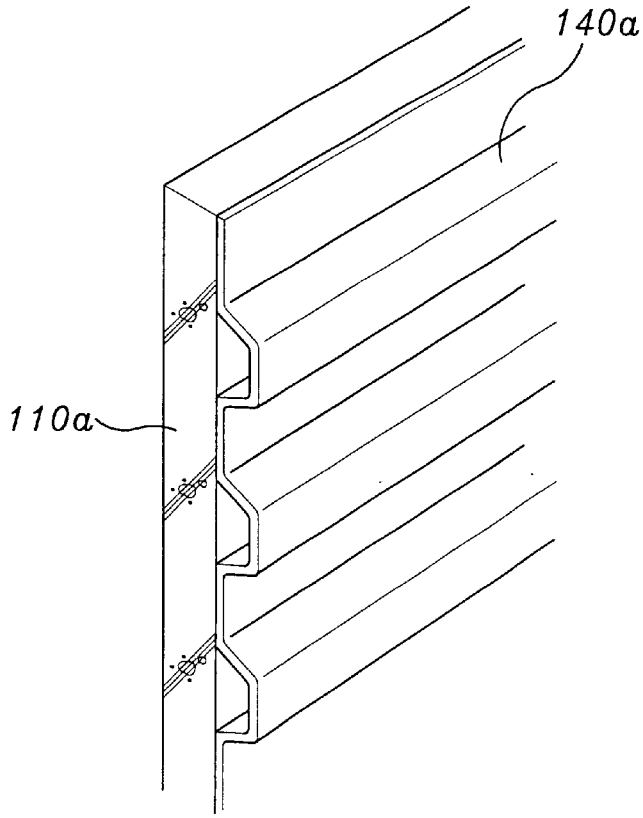
Figure 7D:
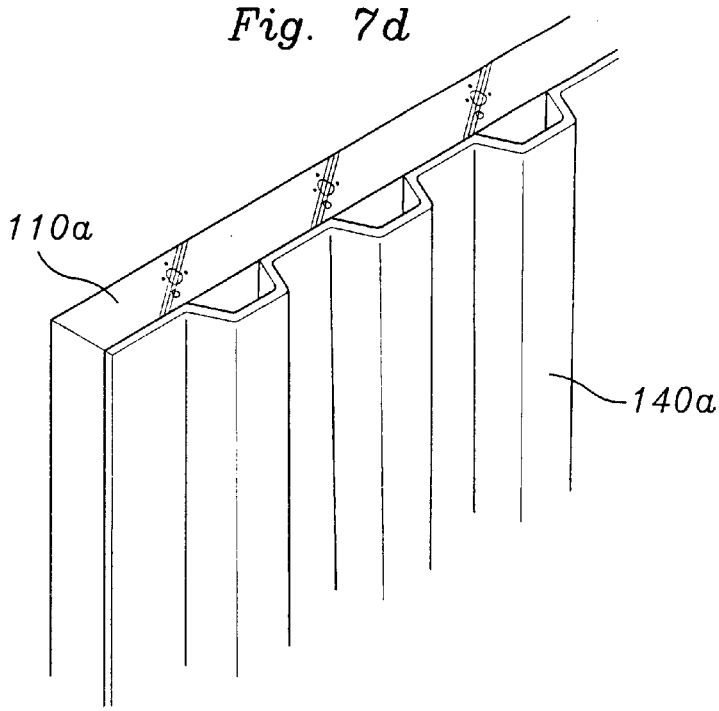

FIGS. 7*c* and 7*d* are perspective views showing examples of condensation inductor formed with a waved steel sheet on the plain concrete wall.

Figure 8A:
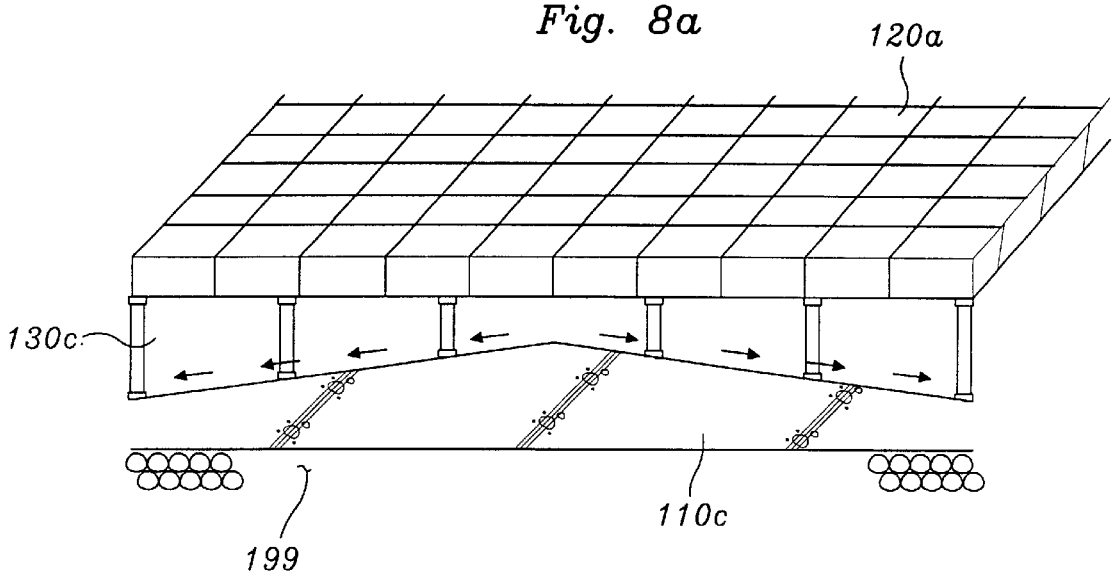
Figure 8B:
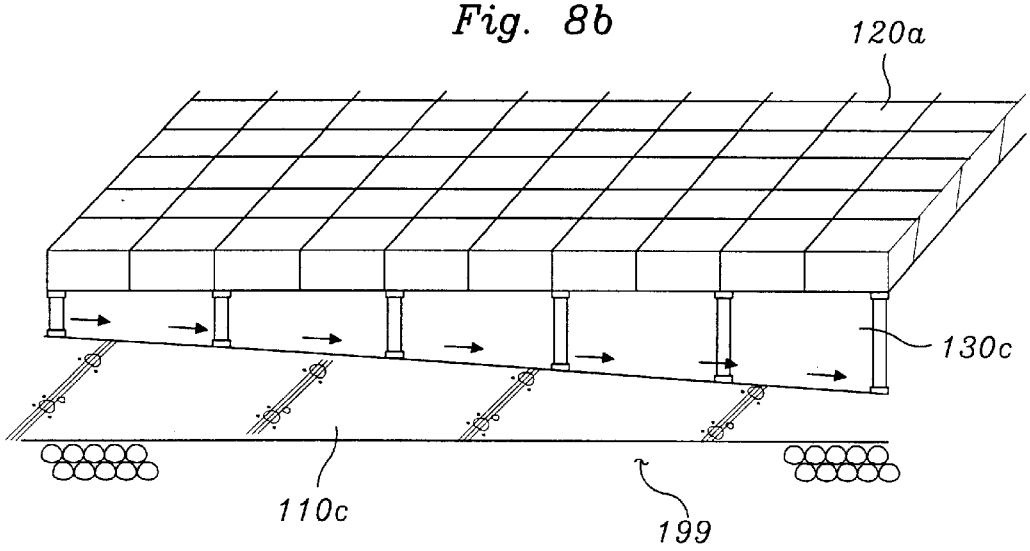
Figure 8C:
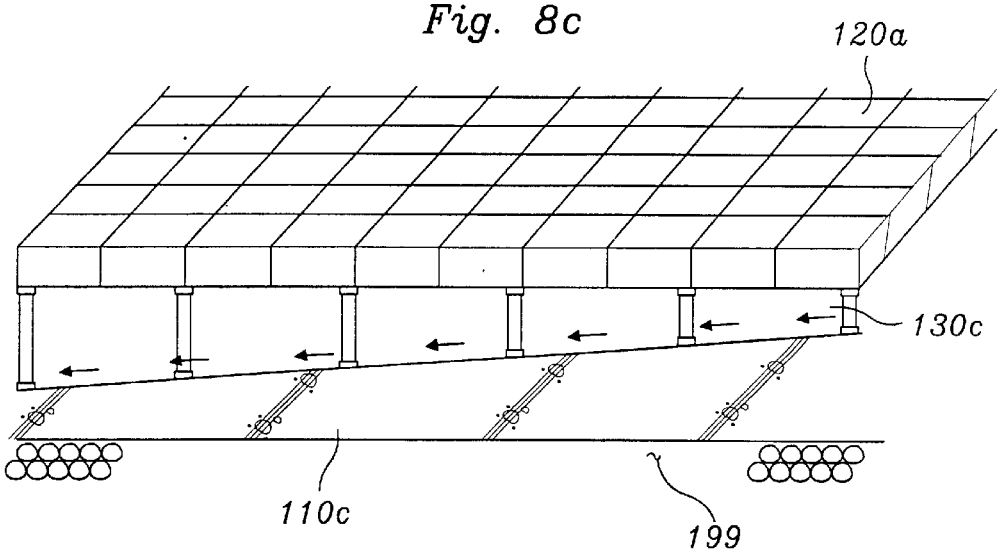

FIGS. 8*a* to 8*c* are showing examples of which the inside bottom is formed with full grating.

Figure 9A:
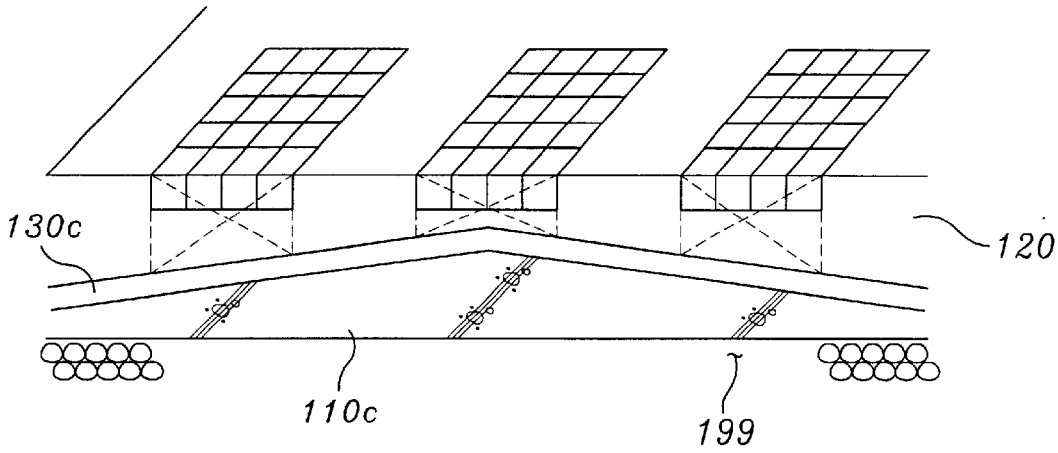
Figure 9B:
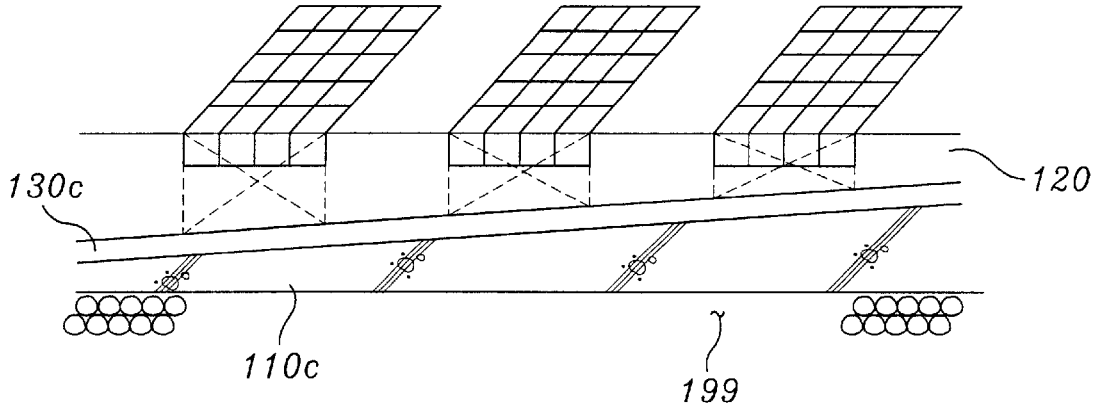
Figure 9C:
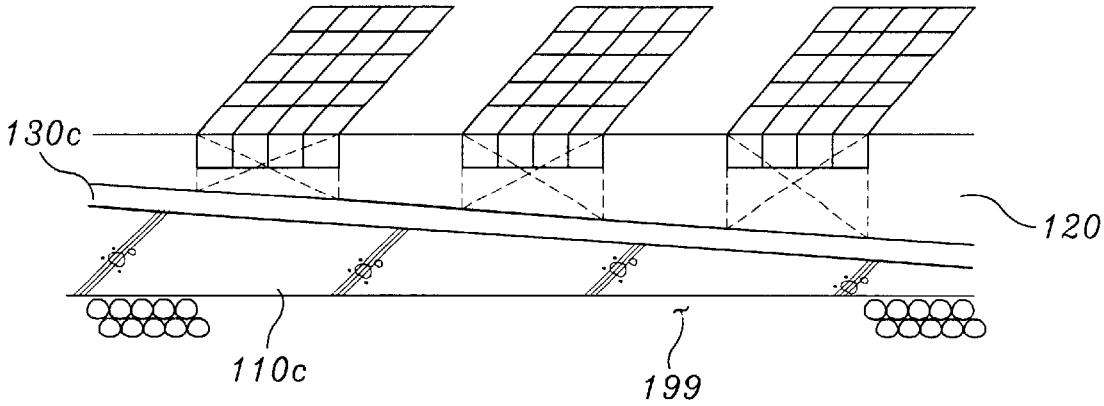

FIGS. 9*a* to 9*c* are showing the inside bottom formed with partial grating.

Figure 10:
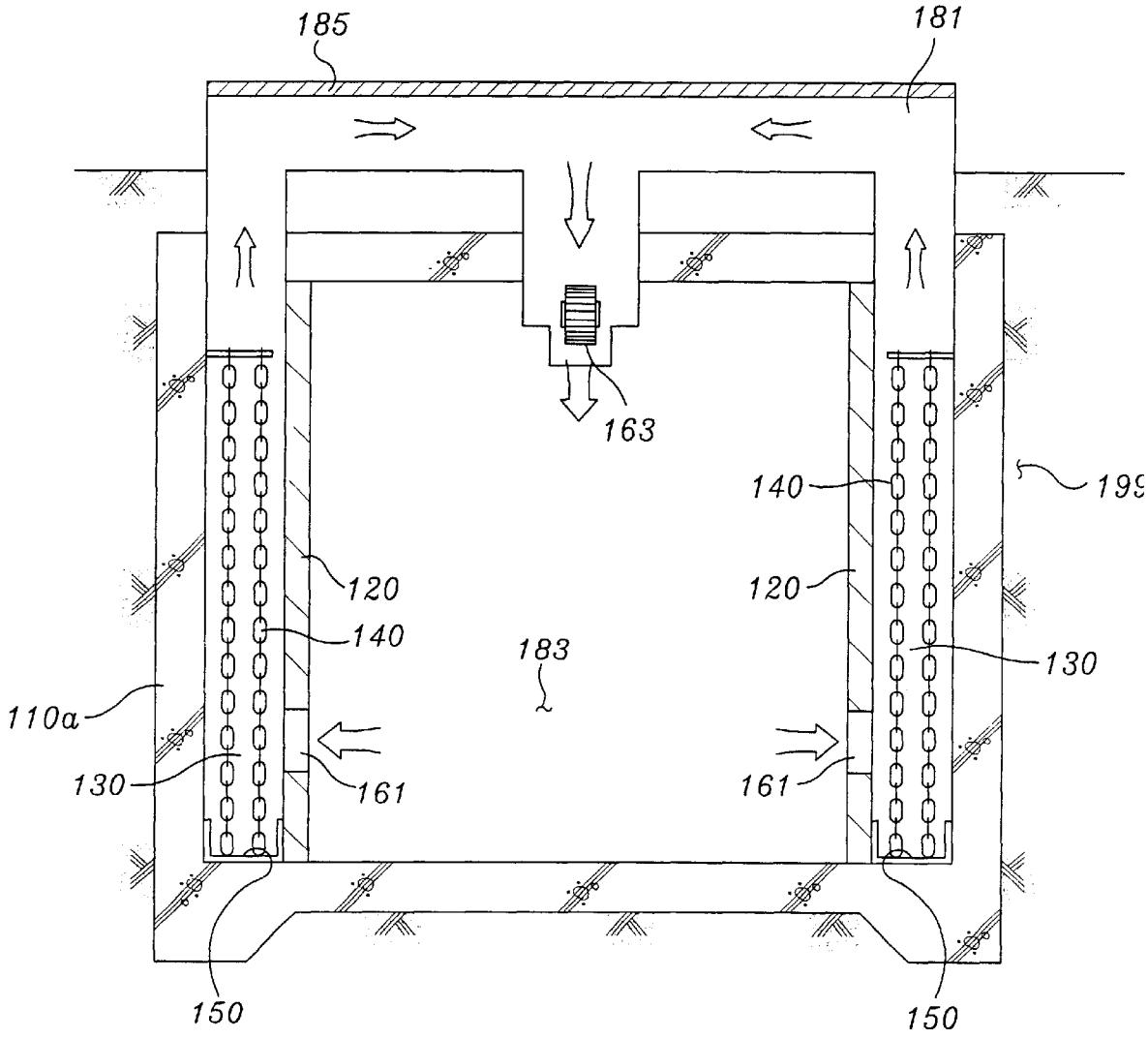

FIG. 10 is a cross sectional view showing an underground facility having one example of a heat-up area according to the present invention.

Figure 11:
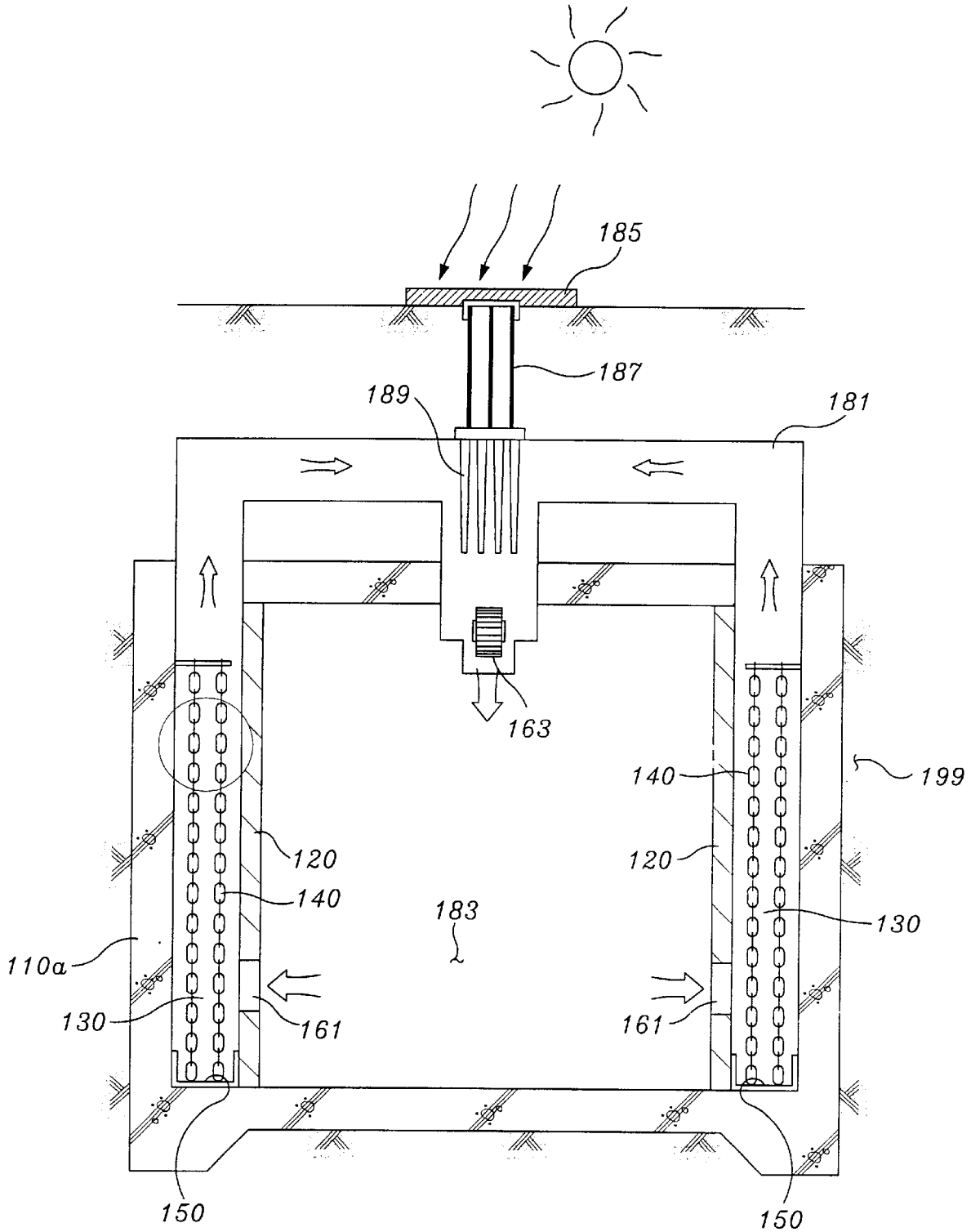

FIG. 11 is a cross sectional view showing an underground facility having another example of a heat-up area according to the present invention.

DETAILED DESCRIPTION OF THE PREFERRED EMBODIMENTS

Hereinafter, we explain about the present invention in detail referring to some preferred embodiments with drawings.

Preferred Embodiment 1

The FIGS. 4*a* and 4*b* show typical type of the underground facility according to the present invention. An underground facility is constructed under or semi-under the earth (or ground) 199. An inside wall 120 is constructed apart from the wall 110*a* of the underground facility towards the inside of the room with a certain distance. Therefore, a buffering space 130 is formed between the wall 110*a* and the inside wall 120 in which the temperature is lower than that of the room of the underground facility. In the buffering space 130, the temperature is directly effected by the earth 199 or the wall 110*a* which contacts the earth 199. Therefore, the temperature of the buffering space 130 is generally lower than the room temperature of the underground facility. As a result, when the room atmosphere of the underground facility has high humidity and if it flows into the buffering space 130, the moisture of the flown atmosphere is condensed into dewdrops 170.

A lower hole or window for ventilation 161 and an upper windows or holes for ventilation 162 are formed at the lower position and upper position of the inside wall 120, respectively. The atmosphere of the underground facility is flown into the buffering space 130 and it is exhausted from the buffering space 130 through these ventilation windows 161 and 162. If needed, a power fan 163 can be installed at one of the ventilation windows 161 and 162 in order for the inner atmosphere in the room of the underground facility to circulate compulsorily through the buffering space 130.

If the outside atmosphere from the aboveground has higher temperature and humidity than that of the underground room, it compulsorily flows into the buffering space 130 through the lower ventilation window 161 by the power fan 163. As the moisture is heavier than dry air, it is better if the high humidity air inflows through the lower ventilation window 161. In the buffering space 130, the moisture of the inflow air is mostly condensed to be dewdrops 170 on the surface of the wall 110*a*. Then, the inflow air is converted into dry and cool air and exhausted back to the room of the underground facility through the upper ventilation window 162. It is better if a ventilation duct 164 is installed to bridge the facing upper ventilation windows 162 forming the two faced inside walls 120.

In order to enhance the condensation effect at the buffering space 130, it is preferable if the temperature difference between the room of the underground facility and the buffer space 130 is big. Therefore, the inside wall 120 has a heat insulating material. If the dewdrop 170 is absorbed into the inside wall 120, the heat insulating performance is lowered. Therefore, it is better if the inside wall 120 does not absorb moisture. Especially, the surface of the inside wall 120 towards the buffering space 130 should have the waterproof capacity.

A water drainage trench 150 is constructed at the bottom of the buffering space 130 in order to drain the water from the condensation to outside. For effective drainage, the water drainage trench 150 has a slop way or a ramp.

Preferred Embodiment 2

In the present invention, it is important to make the condensation compulsorily in order to eliminate the moisture effectively in the room atmosphere of the underground facility. Especially, the condensation should occur only in the buffering space. Therefore, it is better if a condensation inductor is installed in the buffering space.

The FIGS. 5*a* and 5*b* show one example of this embodiment including a condensation inductor 140 using a steel chain hanging on the wall 110*a*. The condensation inductor 140 can have the similar temperature with the earth 199 or the wall 120 through radiation. So that, the moisture in the inflow air can be condense more easily into dewdrops at the surface of the condensation inductor 140.

To induce the condensation more effectively, it is better if the material of the condensation inductor 140 has high thermal conduction so that the cooling radiation occurs rapidly from the earth. Generally, metals having the high density, i.e., the heavier mass per unit volume, are preferred to be the typical material for the condensation inductor 140. Furthermore, it should not be rusted by the moisture or the dewdrops. For example, a stainless steel or a copper which does not rust anymore once its surface is rusted is good for the condensation inductor material.

Furthermore, the condensation inductor 140 should contact the earth 199 or the wall 110*a* which has the lowest temperature among the underground circumstance. Here, the wall means the outer case of the underground facility contacting the earth, that is at least one of the underground wall, the ceiling and the bottom is included in the term, "wall". Therefore, the cold temperature is continuously transferred to the condensation inductor 140.

Here, the one concerned is the shape of the condensation inductor. It is preferred that the surface of the condensation inductor contacts more amount of the air which inflows into the buffering space 130 as possible. Simultaneously, the air flow through the buffering space 130 can be easily performed. Therefore, the shape of the condensation inductor 140 is either a chain, pipe, grid or honey comb structure. The FIG. 6 shows another example of this embodiment including a condensation inductor 140 using a honey comb structure on the wall and using another type of ventilation window 161 and 162 and ventilation fan 163.

Preferred Embodiment 3

In this embodiment, we explain variations of the condensation inductor in detail. The FIGS. 7*a* and 7*b* show the first and second example of the condensation inductor formed with a concrete wall 110*a* having the ridge and furrow surface 140*a*. The FIGS. 7*c* and 7*d* shows the third and fourth example of the condensation inductor 140 formed with a plain concrete wall 110*a* and a waved metal sheet attached on the concrete wall.

According to the preferred embodiment 1, the wall 110*a* of the underground facility is constructed as the inside surface of the wall has a ridge and furrow shape. The concrete is a good material for the condensation inductor 140. So that, the area of the surface is maximized hence, the inflow air contacts the condensation inductor 140. The FIG. 7*a* shows the pattern of the ridge and furrow arrayed in a horizontal direction and the FIG. 7*b* shows the pattern of the ridge and furrow arrayed in a vertical direction.

Generally, in order to construct the surface of the concrete wall having the ridge and furrow shape, a molding panel having the ridge and furrow shape is installed at the position where the wall is constructed at first. Then the concrete wall is constructed. And the molding panel is removed. At this point, if the molding panel is a better material for condensation inductor 140, then there is no need to remove the molding panel. Therefore, the molding panel can increase the effect of the condensation in maximum.

According to the preferred embodiment 1, the wall 110*a* of the underground facility is constructed with plain surface. And a waved metal sheet is fixed on the surface of the inside surface of the wall 110*a*. The FIGS. 7*c* and 7*d* show the various patterns of the waved metal sheet used as a condensation inductor 140.

Preferred Embodiment 4

In this embodiment, the core technique is applied at the bottom of the underground facility. The bottom of the underground facility is fully buried in the earth 199, so the bottom 110C is the coldest surface of the underground facility. Furthermore, the air which is high in humidity or which has over humidity generally sinks down as the wet air is heavier than the dry air. Therefore, the bottom part is a good place for inducing the condensation compulsorily. The FIGS. 8*a* to 9*c* show various examples of this embodiment according to the present invention.

An underground facility is constructed semi-under the earth (or ground) 199. The bottom of the underground facility has a slop for draining the water from the condensation to at least one side of the underground facility. A inside bottom is installed on the bottom with a certain distance. So, a buffering space is formed between the bottom and the inside bottom. Generally, in the inside bottom, the goods are stored and working men and carriers move around. So the room air easily flows into the buffering space and exhausted therefrom. So, it is preferred that the inside bottom has a grating part. The FIGS. 8*a* and 9*c* show some examples of this embodiment in which the various slops are applied. The FIGS. 8*a* to 8*c* show examples of which the inside bottom is formed with full grating, and the FIGS. 9*a* to 9*c* show the inside bottom formed with partial grating. The FIGS. 7*a* and 8*a* have two slops, that is, the center part of the bottom is higher than the two side part. The FIG. 8*b*, 8*c*, 9*b* and 9*c* are formed with one slop, that is, the one side of the bottom is higher than the others. If needed, a condensation inductor can be installed between the bottom 110*a* and the inside bottom 120*a*.

Preferred Embodiment 5

According to the present invention, when the air with high temperature and high humidity flows into the underground facility from outside, the air is flown into the buffering space by this dehumidification system. In the buffering space, the moisture in the air which is flown from the underground facility is eliminated and this air returns to the room of the underground facility. The buffering space has similar temperature to the earth (underground) temperature as it contacts the underground directly and therefore, the temperature is lower than that of the room of the underground facility. In other words, the air inside the buffering space has lower temperature than the air of the underground facility while the moisture in the air is eliminated. In this circumstance, the dew point drops when the air contacts the surface of the stored goods and as a result a slight problem of dew occurs on the surface of the stored goods. In order to prevent this from happening, the temperature of the air circulated from the buffering space to the room of the underground facility needs to be heightened slightly so that it would be similar to the temperature of the room. However, the heightened temperature should not exceed the temperature of the room.

The FIG. 10 shows one example of this preferred embodiment. Considering that the condensation problem in the underground facility generally occurs in summer, the heat area 181 can get its heat source from the sun not from the artificial energy. Below is the example applied in case the upper part of the underground storage facility is constructed near the earth or in case it is constructed as a semi-underground facility. The heat area 181 exposed above the earth is formed between the outer portion of the buffering space 130 and the room 183 of the underground facility. The air in which the moisture eliminated in the buffering space 130 flows through the heat area 181 and after heightening the temperature slightly, it is returned to the room of the underground facility.

The FIG. 11 shows another example of this preferred embodiment. This example is applied in case the upper part of the underground storage facility is constructed deep down the earth. In this case, an heat collector 185 is installed above the ground. An heat transferring means 187 such as an heat pipe installed between the heat collector 185 and the heat area 181. An heat radiator 189 is connected to the end of the heat transferring means 187 and is installed inside the heat area 181. Therefore, the high humidity air is dried through the buffering space 130. Then temperature of the dried air is heightened to the temperature of the room 183 of the underground facility under the condition that it does not exceed the temperature of the room and the air of the heat area 181 flows back into the room.

THE ADVANTAGES OF THE PRESENT INVENTION

The present invention suggests an underground facility for storing goods having a dehumidification system and a method for eliminating the moisture in the air infiltrated from outside in which the air is higher in temperature and humidity than the underground facility. According to the present invention, the dehumidification system is constructed using the buffering space formed at the near space of the wall. The humidification of the present invention is performed by inducing the condensation in the buffering space. Therefore, there is no need to install any air conditioner nor dehumidifier which costs a lot to buy on the first hand, consumes electrical power constantly and which needs maintenance cost during the usage.

What is claimed is:

1. An underground facility having a dehumidification system comprising:

an outer wall;

an interior wall spaced from said outer wall of the underground facility, said interior wall defining an interior space of said facility;

a buffering space formed between said outer wall and the interior wall, wherein said interior wall divides said buffering space from said interior space of the underground facility and;

ventilation means which air circulates between the interior space and the buffering space.

2. The underground facility according to the claim 1, wherein said interior wall comprises a heat insulating material.

3. The underground facility according to the claim 1, wherein the surface of said interior wall facing said buffering space comprises a waterproof material.

4. The underground facility according to the claim 1, wherein the ventilation means comprises:

a lower ventilation window at a lower position on said interior wall;

an upper ventilation window at an upper position on said interior wall and;

a ventilation fan exhausting inflow air from said interior space into the buffering space through the lower ventilation window and back to said interior space through the upper ventilation window.

5. The underground facility according to the claim 4 further comprising heating means wherein air exhausted from the buffering space is heated before flowing into said interior space of the underground facility.

6. The underground facility according to the claim 1 further comprising a condensation inductor in the buffering space.

7. The underground facility according to the claim 6, wherein the condensation inductor is formed of a material selected from the group consisting of steel, stainless steel, aluminum, copper and mixtures thereof.

8. The underground facility according to the claim 6, wherein the condensation inductor is comprised of a waved sheet, chain, or honey comb type panel.

9. The underground facility according to the claim 6, wherein the condensation inductor includes a concrete surface having a ridge and furrow shape.

10. The underground facility according to the claim 1 further comprising heating means connected to the ventilation means wherein air dried in the buffer space is heated to the temperature of the interior space of the underground facility.

11. The underground facility according to the claim 10 further comprising a thermal collector and heat transfer means transferring the heat collected from said thermal collector to said heating means.

12. A method for dehumidification of air in an interior space of an underground facility comprising the steps of:

providing a buffering space between an outer wall of said underground facility and an interior wall spaced from said outer wall, said interior wall defining an interior space of said underground facility;

causing air to flow from said interior space into the buffer space having the lower temperature than said interior space so that moisture in said air is eliminated by condensation;

exhausting said air in the buffer space back into said interior space of the underground facility upon moisture being eliminated therefrom.

13. The method for dehumidification according to the claim 12, further comprising heating said air once moisture is eliminated therefrom prior to being exhausted into said interior space.

* * * * *